US009974148B2

(12) United States Patent
Eskonen et al.

(10) Patent No.: US 9,974,148 B2
(45) Date of Patent: May 15, 2018

(54) LIGHTING CONTROL SYSTEM FOR ROUTING OF MESSAGES BETWEEN A NUMBER OF LIGHTING NODES FORMING A WIRELESS MULTI-NODE NETWORK AND METHOD THEREFOR

(71) Applicant: Tvilight B.V., Groningen (NL)

(72) Inventors: Henri Eskonen, Groningen (NL); Chintan Shah, Groningen (NL); Ralph Hogenbirk, Groningen (NL)

(73) Assignee: TVILIGHT B.V., Groningen (NL)

( * ) Notice: Subject to any disclaimer, the term of this patent is extended or adjusted under 35 U.S.C. 154(b) by 0 days. days.

(21) Appl. No.: 15/328,400

(22) PCT Filed: Jul. 24, 2015

(86) PCT No.: PCT/NL2015/050546

§ 371 (c)(1),
(2) Date: Jan. 23, 2017

(87) PCT Pub. No.: WO2016/013939

PCT Pub. Date: Jan. 28, 2016

(65) Prior Publication Data

US 2017/0208670 A1 Jul. 20, 2017

(30) Foreign Application Priority Data

Jul. 24, 2014 (NL) ..... 2013247

(51) Int. Cl.
*H05B 37/02* (2006.01)

(52) U.S. Cl.
CPC ..... *H05B 37/0272* (2013.01)

(58) Field of Classification Search
CPC .... H05B 37/0272; H04W 8/005; H04W 8/26; H04W 84/18; H04W 4/005; H04W 4/008;
(Continued)

(56) References Cited

U.S. PATENT DOCUMENTS

| | | | | |
|---|---|---|---|---|
| 2009/0066540 | A1* | 3/2009 | Marinakis ..... | H05B 37/0272 340/909 |
| 2012/0059622 | A1 | 3/2012 | Cacace | |
| 2013/0181609 | A1 | 7/2013 | Agrawal | |

FOREIGN PATENT DOCUMENTS

| | | |
|---|---|---|
| EP | 2131630 | 12/2009 |
| WO | WO-2013030779 | 3/2013 |

* cited by examiner

*Primary Examiner* — Dedei K Hammond
(74) *Attorney, Agent, or Firm* — Marcus C. Dawes; Daniel L. Dawes

(57) ABSTRACT

The invention relates to a lighting control system for routing of messages between a number of lighting nodes forming a wireless multi-node network and method therefor. The lighting control system comprising a number of lighting nodes forming a wireless multi-node network, each lighting node comprising a light source; a controller connected to the light source; and a wireless communication means connected to the controller for communication with other lighting nodes in the network, wherein the system is arranged to select for each first lighting node at least one second lighting node to which the wireless communication means of said first lighting node is to establish a routing connection on the basis of information about the geographical position of said first lighting node and the geographical position of said second lighting node.

14 Claims, 9 Drawing Sheets

(58) Field of Classification Search
CPC ..... H04W 4/22; H04W 52/04; H04W 84/12; G08C 17/02; G08C 2201/40; G08C 2201/93
See application file for complete search history.

LIGHTING CONTROL SYSTEM FOR ROUTING OF MESSAGES BETWEEN A NUMBER OF LIGHTING NODES FORMING A WIRELESS MULTI-NODE NETWORK AND METHOD THEREFOR

The invention relates to lighting control systems. Such systems include a number of light sources and at least one controller connected to the light sources for controlling them, e.g. dimming them, switching them on or off and/or changing their color. Lighting control systems are typically used in outdoor lighting, wherein a number of light posts illuminate a road, a walkway or a square for example. Outdoor lighting improves visibility and increases safety.

However, continuously illuminating the street of an area, such as a city or a municipality, requires a large amount of energy. Furthermore, street lighting contributes to a phenomenon called 'light pollution', which relates to artificial light causing a disturbing factor in the environment for humans and animals, e.g. causing sleep deprivation or animal migration. Light pollution may further lead to an artificial 'sky glow', i.e. artificial illumination of the night sky.

Intelligent lighting systems overcome such problems. Typically, such systems comprise a motion detector to detect a vehicle or pedestrian, where the intensity of the individual lights in the system are controlled on the basis of this detection. For example, lights in the system are normally dimmed to a low light level, wherein the light level is increased locally upon detection of a vehicle or pedestrian.

Often, coordination between the lights is desired to control the pattern in which the lights dim, glow and/or switch on or off. For example, it may be desired that the lights cooperate to create an envelope of light around a moving vehicle or pedestrian. In such a system communication connections between the individual lights are required. In many cases, this is achieved by means of wireless communication, wherein the lights form a wireless multi-node network. A light equipped with a communication means in such a system is referred to as a lighting node.

Such an intelligent lighting system is for example described in WO 2014/126470 A1 "Lighting control system and method for association of nodes in a multi-node network", filed Feb. 14, 2014 and the corresponding Dutch patent NL 2010324 C, filed Feb. 18, 2013 of the same applicant as the current invention. The entire content of these patent applications is hereby incorporated by reference.

The invention addresses a problem in the communication between lighting nodes within conventional lighting systems employing a wireless network. The number of messages sent between the nodes can become large, especially as the number of lighting nodes in the network increases. This can lead to an overload of the wireless network, leading to a delay in message delivery or even a loss of messages. Moreover, the frequency band used for the wireless communication between nodes, e.g. the 2.4 Ghz band, may also be used by other wireless technologies such as WiFi or Bluetooth, as for example used by smartphones. As the frequency band gets crowded, the communication connection between lighting nodes may become unreliable.

A communication delay in the lighting network may result in a noticeable delay in the adjustment of the light levels of the lighting nodes. For example, such a communication delay may result in an unsafe situation wherein the light level of some of the lights in the system is not applied in the required time span, e.g. only after a vehicle or a pedestrian passes the lights. In a worst case scenario, wirelessly transmitted messages may be lost all together and some lights in the system may not adjust their light level at all when they are required to.

An objective of the invention is to minimize or at least reduce the network traffic in the wireless multi-node network of lighting nodes and to minimize or at least reduce the delay in communication between nodes.

The objectives are achieved with the lighting control system according to the invention, the system comprising a number of lighting nodes forming a wireless multi-node network, wherein each lighting node comprises:

- a light source;
- a controller connected to the light source; and
- a wireless communication means connected to the controller for communication with other lighting nodes in the network, characterized in that the system is arranged to configure the network for the routing of messages between the lighting nodes on the basis of information about the geographical positions of the lighting nodes, the system being arranged to select for each first lighting node at least one second lighting node to which the wireless communication means of said first lighting node is to establish a routing connection on the basis of information about the geographical position of said first lighting node and the geographical position of said second lighting node.

Possible light sources include any dimmable lamp, such as sodium-vapor lamps, incandescent light bulbs, halogen lamps and LEDs. The invention will be explained mainly in reference to a street lighting application. Other application areas may include lighting in a parking lot, parking garage or indoors, such as in warehouses, production facilities, airports or hotels.

The inventors found that the problems described above are at least partially caused by a sub-optimal routing of messages in the network of wireless nodes. This is illustrated in FIG. 1A, which shows a network of lighting nodes according to the prior art. In the system according to FIG. 1A, lighting nodes a-w are arranged alongside a number of intersecting roads 2. The nodes a-w communicate to each other via a wireless network protocol, for example Zigbee. In the illustrated example each node can act as a routing node for routing messages to other nodes according to a parent-child hierarchy. In the illustrated example each node tries to set up a connection to one parent node and each node may have up to five child nodes. In FIG. 1A the arrow of each communication connection between nodes points toward the parent node. However, it is noted that messages may be exchanged in both directions: from child to parent and from parent to child.

The formation of the network of the wireless nodes is decentralized. Moreover, the final routing configuration of the network is unpredictable. On startup, each node tries to connect to other nodes in the network using a "first come first serve" strategy. As can be seen from FIG. 1A, the network is formed with node w being the parent of nodes k, n, t, u, v; node k being the parent of nodes a, h, i, j, l; node n being the parent of nodes g, m and possibly up to three additional nodes, and node g is the parent of nodes b, c, d, e, and f. The hierarchy between nodes has been further illustrated in the tree diagram of FIG. 1B.

Each node in the network communicates with the other nodes by sending messages via its parent node. For example, if node u is to communicate with node v, it sends a message to node w, which forwards the message to node v. In the shown example, if node a is to communicate with node b, which is neighboring node a along the road 2, the message is routed from node a to its parent node k, subsequently to k's parent node w, then to w's child node n, then to n's child node g, and finally to node b. In this example, the message from a to b is therefore routed using five hops.

According to the invention, the routing of the network is configured taking into account the geographical lay-out of the system. Instead of an ad-hoc network formation, the invention uses information about the positions of the lighting nodes to form the communication connections for routing messages between the nodes. This significantly reduces the number of hops required for communication between the nodes as opposed to conventional wireless implementations.

The information about the geographical positions of the lighting nodes may for example comprise the geographical coordinates of the nodes, e.g. their GPS position. For example, the geographical coordinates include latitude and longitude. Optionally, the coordinates include elevation.

The system may comprise a central server in communication with the lighting nodes that stores the information about the geographical position of the lighting nodes. For example, the nodes comprise a GPS device and communicate their respective location to the central server. Preferably however, the nodes do not comprise a GPS device and the geographical position of the lighting nodes is provided on the server by other means. For example, upon installation of a lighting node the GPS position of the node is determined, for example using an external GPS device such as a smartphone or laptop, after which the GPS position is input to the server. Preferably, the information about the geographical positions of the lighting nodes on the server is editable. This enables fast and easy correction of the location of the nodes in the system, e.g. when the position of the lighting nodes is changed or when an error has been made in programming the node location. The server may also comprise a visualization component for displaying the positions of the lighting nodes on a map, by using digital mapping tools such as Google Maps™ or Bing Maps™. Reference is made to WO 2014/126470 A1 and NL 2010324 C (incorporated by reference) wherein such a server and database are described in more detail.

The system may configure the routing of the network automatically and/or dynamically according to the information about the geographical position of the lighting nodes. For example, if a node fails and drops out of the network, the system may reconfigure the routing dynamically on the basis of the information about the geographical position of the lighting nodes.

It is noted that in conventional intelligent lighting systems, the geographical positions of the lighting nodes also play a role in the formation of the wireless network, as the nodes can only connect to other nodes with a certain communication range. In a sense, the routing of a conventional network is thereby influenced by the geographical positions of the nodes. However, such conventional networks are not organized on the basis of information, i.e. data, on the geographical position of the lighting nodes. In contrast, in the invention the information about the geographical position is provided as input data to the system, and the system configures the network on the basis of said position data.

In the context of the application, a direct or first order neighbor of a first node is a second node which is directly next to the first node on a respective path or within a respective area. The second order neighbor of a first node is a second node which is separated from the first node by exactly one other node. Generally, an n-th order neighbor of a first node is a second node which is separated from the first node by exactly (n−1) other nodes. For example, for nodes a, b, c, d and e arranged in that order along a common path (see e.g. FIG. 1*a*), node c has first order neighbors b and d and second order neighbors a and e, and node e has first order neighbor d, second order neighbor c, third order neighbor b and fourth order neighbor a.

According to the invention the system is arranged to select for each first lighting node at least one second lighting node to which the wireless communication means of said first lighting node is to establish a routing connection, wherein the system is arranged to select said second lighting node on the basis of information about the geographical position of said first lighting node and the geographical position of said second lighting node.

For example, the system may comprise a coordinator node or server to coordinate the formation of the network. The coordinator node or server determines for each first node the one or more second nodes to which it is to establish a routing connection. The coordinator node or server communicates this information to the respective node. In an alternative example, each node itself determines the one or more other nodes to which it is to establish the routing connection on the basis of information about the geographical position of other lighting nodes. Said information may be communicated between the nodes.

In a further preferred embodiment, the system is arranged to configure the network for routing of messages between the lighting node on the basis of information about the infrastructural lay-out of the area wherein the lighting nodes are positioned, and the geographical positions of the lighting nodes in said area.

In other words, the system configures the routing of the network on the basis of the physical lay-out of the lighting nodes with respect to its infrastructural context, such as roads, intersections, roundabouts or squares.

For example, a number of lighting nodes may be arranged alongside a road. When a car drives along the road, the intelligent lighting system has to adjust the lighting level of the lighting nodes along the road consecutively. Therefore, the system configures the routing within the network such that two consecutive nodes can communicate via at most three hops, preferably via at most two hops and most preferably the two consecutive nodes establish a direct communication connection between each other, i.e. in one hop.

In a preferred embodiment, the system is arranged to select said second lighting node on the basis of information about the infrastructural lay-out of the area wherein the lighting nodes are positioned and the geographical positions of the lighting nodes in said area.

In a further preferred embodiment, the lighting control system comprises:

- a memory component adapted to store information relating to the geographical position of paths, intersections and/or areas of said infrastructural lay-out; and
- a processing component in communication with the lighting nodes and adapted to automatically associate each node to one of the stored paths, intersections and/or areas, and further being adapted to select for each first lighting node at least one second lighting node associated to the same one of said paths, intersections and/or areas.

The memory component stores information relating to groups of interrelated geographical coordinates. These groups may correspond to paths, intersections and/or areas of said infrastructural lay-out, such as roads, intersections, roundabouts and/or squares. The processing component associates each lighting node to one or more of said groups of interrelated coordinates. This classification of the lighting nodes into groups of nodes associated to a certain path, intersection and/or area, enables selecting for each first lighting node at least one second lighting node to which the wireless communication means of said first lighting node is to establish a routing connection.

For example, the system creates path-wise or area-wise associations between the nodes on the basis of their positions and the information about the infrastructural lay-out. Creating such associations is described in detail in WO 2014/126470 A1 and NL 2010324 C, which are hereby incorporated by reference. For example, the nodes within a predetermined distance from a path or intersection are associated to said path or intersection. Subsequently, the system selects for a first node a second node which is associated to the same path, area and/or intersection. For example, the nearest neighbors along a path are selected as second nodes. In another example, all nodes associated with an intersection establish communication connections between each other.

It is noted that in this embodiment, two lighting nodes within each other's communication range will only establish a communication connection between each other if they belong to the same group, e.g. they share a path or belong to the same geographical area or network group.

The information relating to geographical positions of paths, intersections and/or areas may for example be obtained from a map data service, such as OpenStreetMap™, Google Maps™ or Bing Maps™.

In a further embodiment, the processing component is adapted to select for each first lighting node at least one second lighting node neighboring said first lighting node and associated with the same path, intersection and/or area.

In an exemplary embodiment, at least one neighbor of the first node along the same path associated with said first node is determined and a routing connection is formed between said first node and said neighboring node. Therefore, the routing connections for messages within the network takes into account the position of the nodes along the road.

More than one neighbor may be selected. For example, the processing component is adapted to select as second lighting nodes neighboring nodes up to a predetermined order.

The neighbors may be selected symmetrically or asymmetrically. In an embodiment wherein the neighbors are selected asymmetrically, the processing component may select a first number of neighbors in a first direction of the path, intersection and/or area, and a second number of neighbors in a second direction, wherein the first number is different from the second number and the first direction is different from the second direction.

In case a node is associated with a path, the neighbors may be selected in both directions along the associated path. For example, if node A is associated with road R, a predetermined number of neighbors may be selected in a first direction along said road R and a predetermined number of neighbors may be selected in a second direction along said road R, wherein the second direction is opposite to the first direction.

In case a node is associated with an intersection, the neighbors may be selected along each path associated with said intersection. For example, if node A is associated with an intersection of roads R1 and R2, both neighbors along road R1 and neighbors along road R2 may be selected for routing messages. For example, the direct neighbors of node A along road R1 and the direct neighbors of node A along R2 are selected. In one exemplary embodiment the number of neighbors selected in case of an intersection is greater than the number of neighbors selected for a path.

In an example wherein the first node is associated with an area, such as a square or a parking lot, the processing component may select as second nodes all other nodes associated with the same area and within a certain distance from the first node.

In a further preferred embodiment, the system comprises a visualization component connected to the processing component and adapted to show the locations of the lighting nodes and the paths, intersections and/or areas on a map on an electronic display.

In a preferred embodiment, the system comprises a configuration component adapted to edit the associations between the lighting nodes and paths, intersections and/or areas on the basis of user input.

In an exemplary embodiment, the logical topology of the network of the system may be a mesh topology, star topology or a tree topology. In an example, the logical topology is a tree topology, wherein each node can have a parent or child relation to other nodes. In one example, each node has a single parent, wherein the node at the top of the tree may have no parent. For example, each node has up to five child nodes. Moreover, each node may have one or more back-up parent nodes in case the connection to the initial parent node fails.

In a preferred embodiment, each lighting node comprises a switching component arranged for switching between a unicast mode, wherein the wireless communication means of said lighting node is arranged for sending a message to another node in the network via at least one routing connection by using a unique address of said other node, and a broadcast mode wherein the wireless communication means of said lighting node is arranged for sending a message to multiple other nodes in the network within wireless range.

In other words, each lighting node can communicate to other nodes in the network in the unicast mode and/or the broadcast mode. The broadcast mode can be used to communicate with other nodes in a network within wireless range. Instead of sending messages via multiple hops to the destination nodes, a single message is sent. This reduces the number of messages sent within the network. When a node outside the wireless range needs to receive the message, the unicast mode is used, wherein the message travels via other nodes to the destination node, as described above. The message may include an address to identify the destination node.

In a further preferred embodiment, each lighting node comprises a memory component, arranged to store a list of at least two other nodes in the network, indicating whether to send messages to the respective node in the unicast mode or in the broadcast mode.

In a preferred embodiment, each lighting node is arranged such that for sending a message from said lighting node to multiple other lighting nodes, the broadcast node is used for sending said message to the subset of other lighting nodes which are within a predetermined range and the unicast mode is used for routing said message to the subset of other lighting nodes which are outside the predetermined range.

In a further preferred embodiment, the predetermined range is equal to or smaller than the wireless range of the wireless communication means of the respective lighting node.

The practical range of a wireless device may vary, for example due to changing weather conditions or the presence of reflecting or absorbing objects such as buildings or vehicles. The practical range of a wireless device may therefore be lower than the specified wireless range. Therefore, some of the nodes may be within range of each other at a first time, wherein at a later time they are outside each other's range. According to the invention, it is possible to adjust the selection of the unicast mode and broadcast mode by taking into account this fluctuation in range. Preferably, a fixed predetermined range is defined, e.g. corresponding to a worst case scenario for the range. This ensures that the nodes within the predetermined range can always be reached in the broadcast mode.

The invention further relates to a method for routing messages between lighting nodes forming a wireless multi-node network, wherein each lighting node comprises a light source, a controller connected to the light source, and a wireless communication means connected to the controller for communicating with other lighting nodes in a network, the method comprising the step of configuring the network for routing messages between the lighting nodes on the basis of information about the geographical position of the lighting nodes by selecting for each first lighting node at least one second lighting node to which the wireless communication means of said first lighting node is to establish a routing connection on the basis of information about the geographical position of said first lighting node and the geographical position of said second lighting node.

The same advantages and effects as described above with respect to the lighting control system according to the invention apply to the method according to the invention.

In a preferred embodiment of the method, the second lighting node is selected on the basis of information about the infrastructural layout of the area wherein the lighting nodes are positioned and the geographical positions of the lighting nodes in said area. A further embodiment of the method, further comprises:

- obtaining information relating to the geographical position of paths, intersections and/or areas of said infrastructural layout; and
- automatically associating each node to one of said paths, intersections and/or areas; and
- selecting for each first lighting node at least one second lighting node associated to the same one of said paths, intersections and/or areas.

The step of obtaining information may comprise loading data representing the geographical position of paths, intersections and/or areas of said infrastructural layout. Said data may for example be obtained from a map data provider, such as OpenStreetMap™, Google Maps or Bing maps.

In a further preferred embodiment, the method comprises the following steps for sending a message from a first lighting node to multiple other lighting nodes:

- using a broadcasting mode for sending the message to the subset of other lighting nodes which are within a predetermined range; and
- using a unicast mode for routing the message to the subset of other lighting nodes which are outside said predetermined range.

Preferably, the predetermined range is equal or smaller than the wireless range of the communication means of said first lighting nodes.

The invention also relates to a computer program product comprising non-transitory computer-executable instructions configured to, when executed, perform the method as described above.

The invention further relates to a lighting control system comprising a number of lighting nodes forming a wireless multi-node network, each lighting node comprising:

- a light source;
- a controller connected to the light source; and
- a wireless communication means connected to the controller for communication with other lighting nodes in the network, characterized in that each lighting node comprises a switching component arranged for switching between an unicast mode, wherein the wireless communication means of said lighting node is arranged for sending a message to another node in the network via at least one routing connection by using an unique address of said other node, and a broadcast mode, wherein the wireless communication means of said lighting node is arranged for sending a message to multiple other nodes in the network within wireless range.

Said system may or may not be arranged to configure the network for the routing of messages according to position information as described above.

In an embodiment, each lighting node of the system comprises a memory component arranged to store a list of at least two other nodes in the network indicating whether to send messages to the respective node in the unicast mode or broadcast mode.

In an embodiment, each lighting node is arranged such that for sending a message from said lighting node to multiple other lighting nodes the broadcast mode is used for sending said message to the subset of other lighting nodes which are within a predetermined range and the unicast mode is used for routing said message to the subset of other lighting nodes which are outside the predetermined range.

In an embodiment, the predetermined range is equal or smaller than the wireless range of the wireless communication means of the respective lighting node.

The invention further relates to a method for sending a message from a first lighting node to multiple other lighting nodes in a system comprising a number of lighting nodes forming a wireless multi-node network, the method comprising:

- using a broadcasting mode for sending the message to the subset of other lighting nodes which are within a predetermined range; and
- using a unicast mode for routing the message to the subset of other lighting nodes which are outside said predetermined range.

The invention also relates to a computer program product comprising non-transitory computer-executable instructions configured to, when executed, perform the step of the method described in the previous paragraph.

Further details, advantages and effects will be explained with reference to preferred embodiments of the invention, wherein reference is made to the following figures.

Figure 1A:
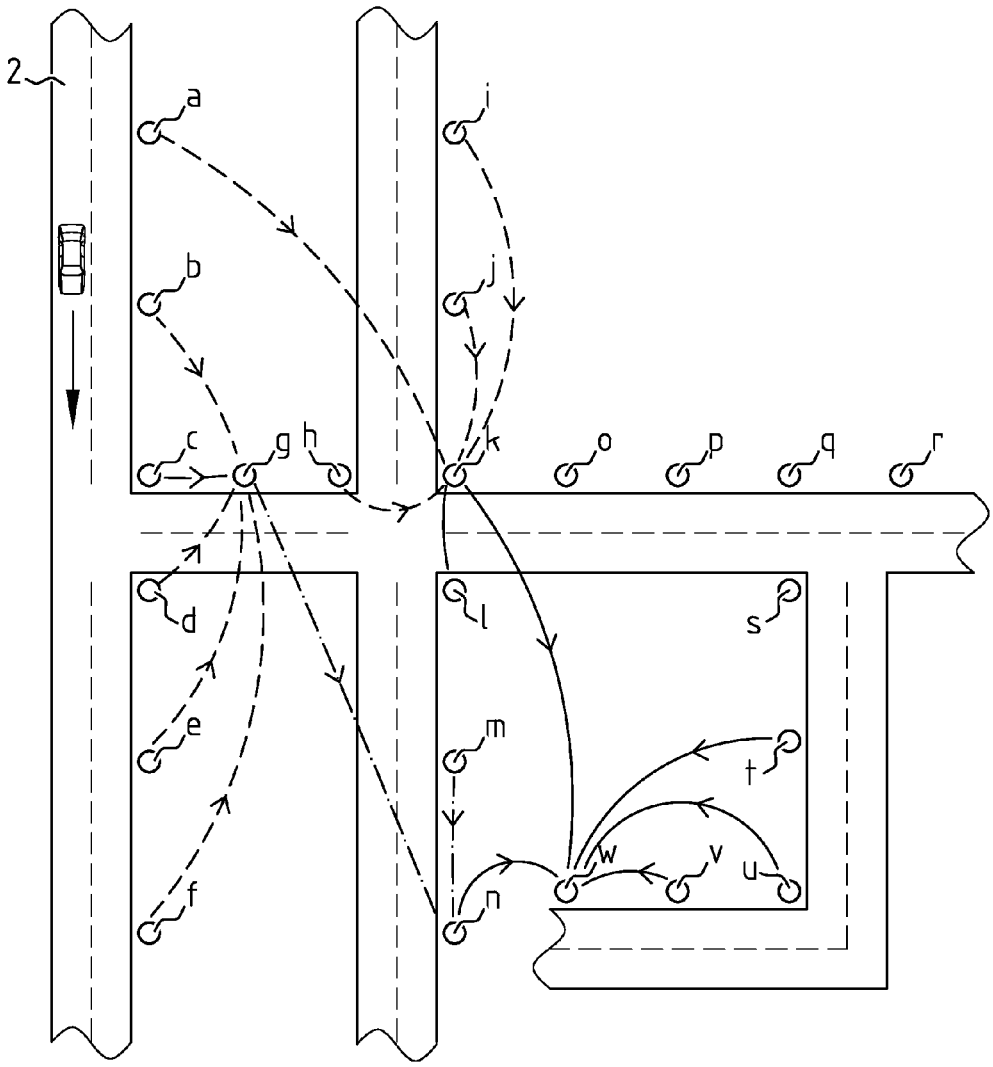
FIG. 1A PRIOR ART
FIG. 1A shows schematically a lighting control system according to the prior art, wherein the communication connections between the wireless nodes have been indicated.
Figure 1B:
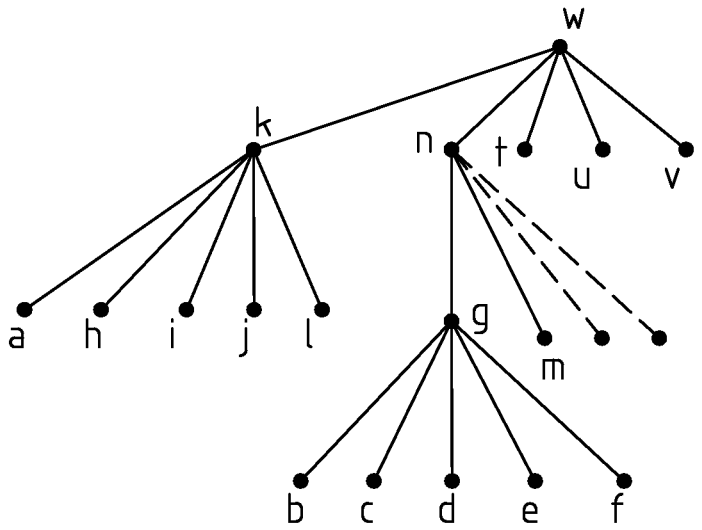
FIG. 1B PRIOR ART
FIG. 1B shows a tree diagram of the network of FIG. 1A.

The problems relating to the lighting control systems according to the prior art as depicted in FIGS. 1A and 1B have been described in the introductory portion of this disclosure. An example of the solution provided by the invention is shown in FIGS. 2A and 2B.

Figure 2A:
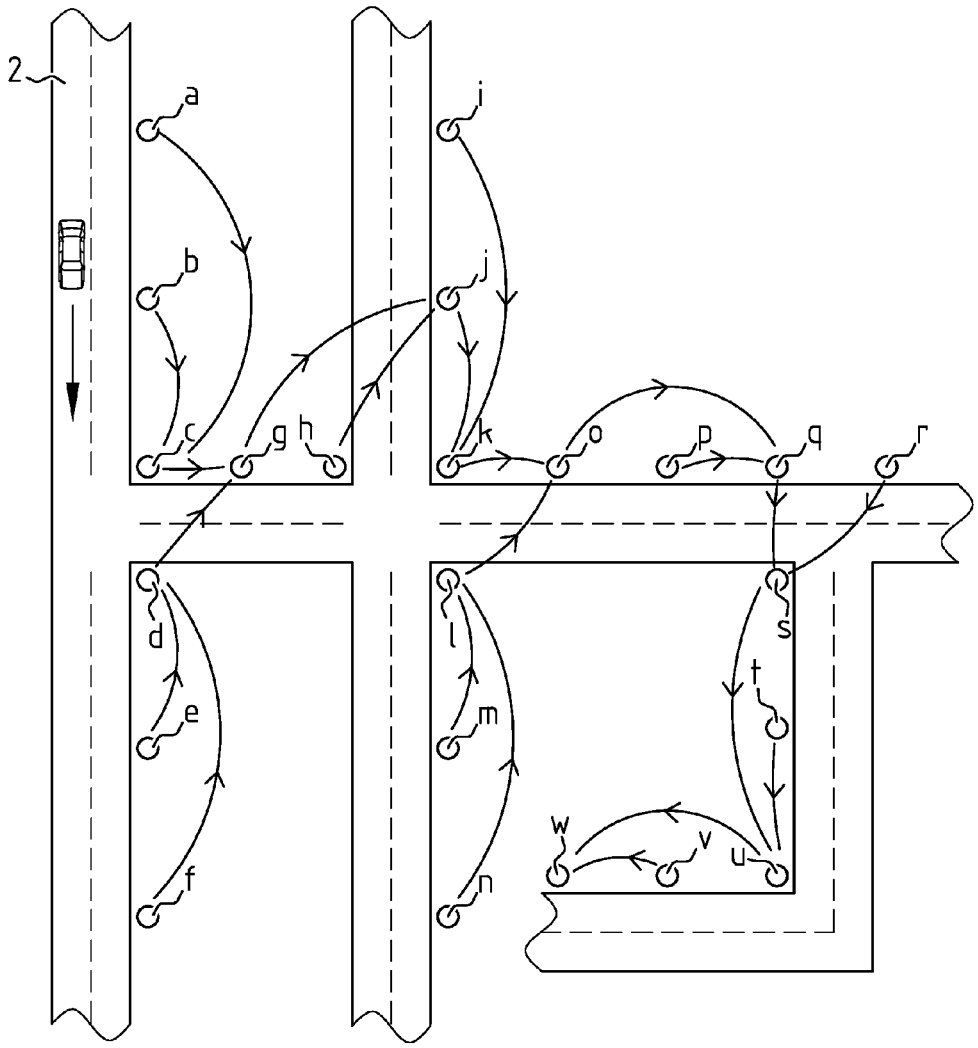
FIG. 2A shows an example of a lighting control system according the invention, wherein the communication connections between the lighting nodes are indicated.
Figure 2B:
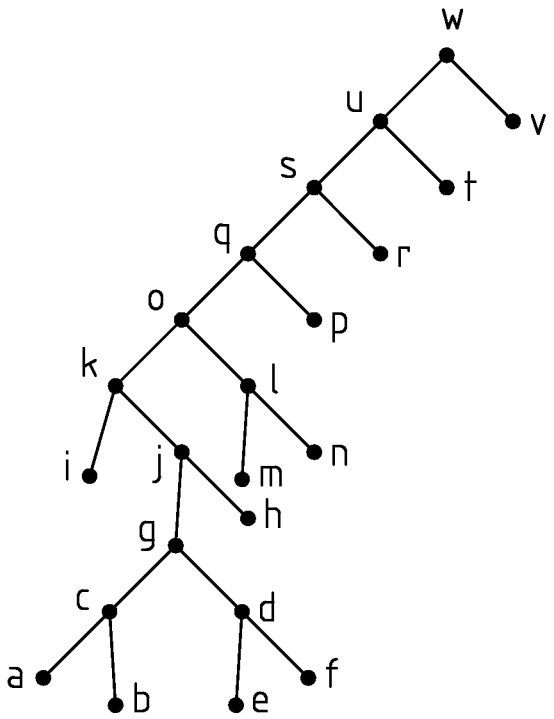
FIG. 2B shows a tree diagram of the network of FIG. 2A.

FIGS. 2A-2B show a network topology wherein each node has at most one parent and at most two children. As can be most clearly seen from FIG. 2B, node w represents the top node of the tree. Node w has two children, namely node u and node v. Node u has children node s and node t; node s has children node q and node r; node q has children node o and node p; node o has children node k and node l; node k has children node i and node j; node j has children node g and node h; node g has children node c and node d; node c has children node a and node b; node d has children node e and node f; node l has children node m and node n.

As can been seen from the figures, the organization of the network substantially corresponds to the lay-out of the infrastructure which the nodes are supposed to illuminate. For example, during a start-up phase a central server (not shown) associates the nodes to a group of interrelated coordinates, such as paths, intersections and/or areas. For example, nodes a and b are associated with the road along which they are positioned, whereas nodes h and k are associated with the nearby intersection. Each node may be associated with more than one group of interrelated coordinates. For example, a node is related to a group of interrelated coordinates, if it is within a predetermined distance from said road, intersection or area. Further reference is made to and NL 2010324 C (incorporated by reference).

For example, data relating to the geographical positions of paths, intersections and/or areas may be loaded. Said data may comprise road data, i.e. data of all roads within an area wherein the lighting nodes of the system are arranged. The road data may comprise for each road a list of points describing said road. The points may be expressed as geographical coordinates e.g. longitude and latitude. The points may for example define end points of interconnected straight lines thereby approximating the road. In other words, the points may define end points of vectors describing a road. After loading the road data, the server may associate each node to a nearby road. The following algorithm may be executed:

ALGORITHM 1:

```
for each node N
        set closest_distance to a high value
        for each road R
                for each point P of the road R
                        calculate distance between the node N and
                        the point P
                        if the calculated distance < closest_distance
                                closest_distance = the calculated
                                distance
                                closest_point = point P
                                closest_road = road R
                        end if
                end for
        end for
        associate node N with road R and point P
end for
```

The variable closest_distance defined in the second line of the above algorithm may for example be initialized to the maximum value for the given data type.

Optionally, the node N may only be associated with the road R and point P if the closest distance obtained with the algorithm is smaller than a predetermined threshold, to avoid node N being associated with roads which are too far away.

The step "associate node N with road R and point P" may include storing an identifier for road R, an identifier for point P and an identifier for node N in an array or matrix.

The road data may in addition describe which points belong to an intersection. Algorithm 1 may be amended in that case to include after its penultimate line:

```
if point P belongs to an intersection I
associate node N with intersection I
end if
```

Note that in such a case the node N is associated both to the closest road R and point P as to the intersection I.

After associating the nodes with roads, intersections and/or areas, the processor or server determines for each node the neighboring nodes along a path. For example, for node b it is determined that node a and node c are direct neighbors to node b while node d and node g are second order neighbors to node b. In the example of FIG. 2B, the server assigns for each node a parent node which is a direct neighbor, i.e. a first order neighbor, or a second order neighbor. This results in the network organization as shown in FIGS. 2A and 2B. As can be seen, the routing within the network substantially follows the shape of the infrastructure, such that each node can communicate with its neighbors within at most two hops. For example, node a can communicate with its neighbor node b in two hops and node b can communication with node c in one hop, i.e. directly.

For example, the following algorithm for determining neighboring nodes on a road may be executed:

ALGORITHM 2:

```
for each node N
        load the list L of points describing road R associated with
        node N
        load the point P of road R closest to node N
        set index IDX to the index of point P in list L
        start loop
                if IDX == last index of list L
                        break from loop
                end if
                IDX = IDX + 1
                obtain the point Q at index IDX in list L
                if a node M is associated with point Q
                        store node M as a neighbor of node N
                        break from loop
                end if
        end loop
        reset index IDX to the index of point P in list L
        start loop
                if IDX == first index of list L
                        break from loop
                end if
                IDX = IDX - 1
                obtain the point Q at index IDX in list L
                if a node M is associated with point Q
                        store node M as a neighbor of node N
                        break from loop
                end if
        end loop
end for
```

In other words, algorithm 2 "walks" along the road associated with node N, point by point. In the first loop, the algorithm looks for neighbors in a first direction along the road. In the second loop, the algorithm looks for neighbors in the opposite direction along the road. The algorithm checks whether a node has been associated with the point Q at every step of the loop. For example, the array comprising the identifiers of associated nodes, points and roads is used for this purpose.

For a long straight road, the end points describing said road may be very far apart. For executing the algorithms above, intermediate points may be added between the end points such that neighboring points are always within a certain distance from each other. Adding said intermediate point may be performed as a first step, performed before executing the algorithms. Alternatively, the data having said intermediate points is stored and the algorithms operate on the amended data. Further alternatively, the algorithms may be amended to work on the vectors described by said end points instead of the end points themselves, thereby taking into account the possibility of long straight roads having end points at a relatively large distance from each other. For example, in algorithm 1 a distance from node N to a vector V is calculated instead of a distance to a point.

It is noted that FIGS. 2A-2B show an example of a tree topology. However, the structure may also comprise nodes having more than one parent node as in a mesh or star topology. In another example, the logical topology of the network is a tree topology, however, each node is assigned a back-up parent, in case the communication connection to its initial parent fails. In yet another example, the topology is a hybrid topology, combining a ring, bus, star, mesh and/or tree topology.

In another example (FIGS. 3A and 3B), the configuration of the network is optimized for connecting each node to its closest neighbors along a path. As can be seen from the figure, node a requires only one hop to communicate with its direct neighbor b and two hops for communicating with its second order neighbor node c. In this example, each node has at most one parent. At the intersection, node k has four child nodes, such that it is connected to its direct neighbors along the two roads which intersect near node k. Also in this example each node may define a back-up parent node in case communication to the initial parent node fails.

Figure 3A:
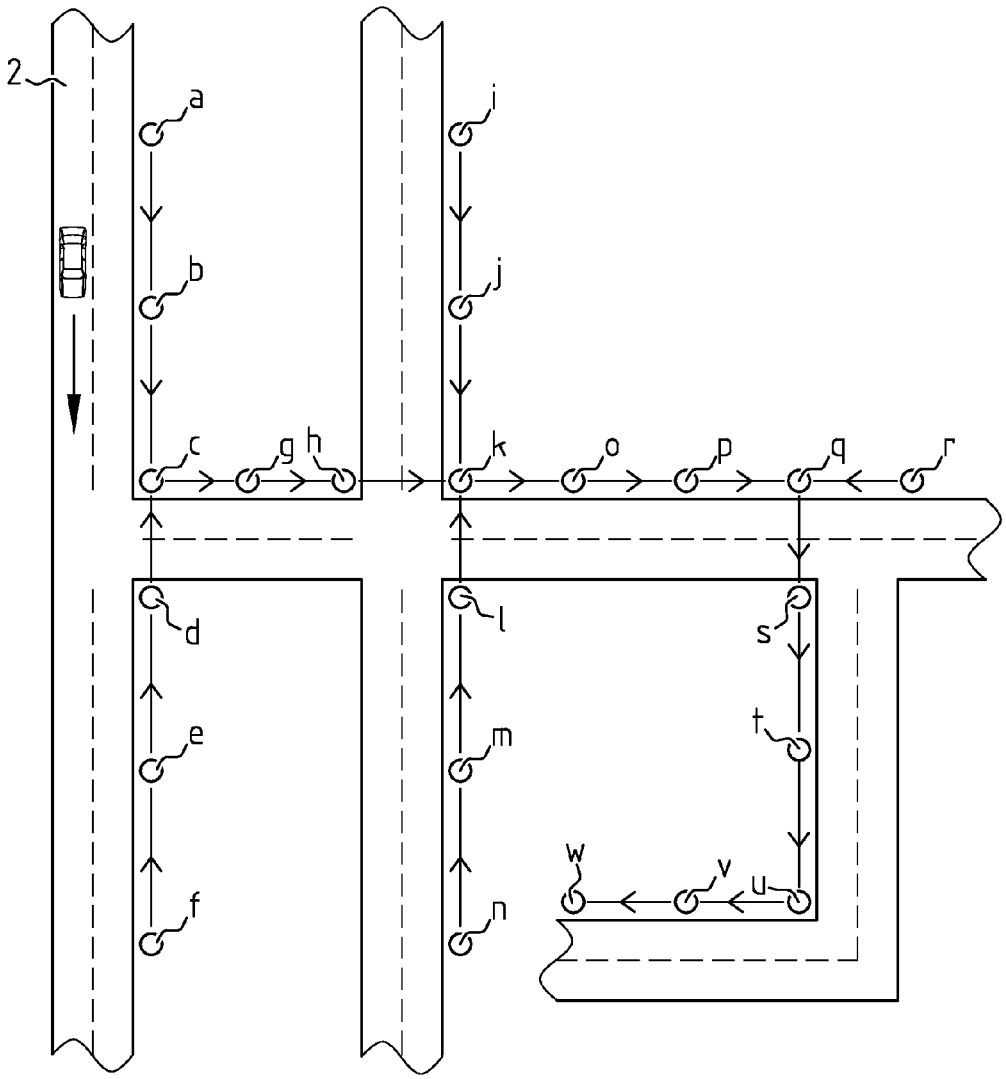
FIG. 3A shows an alternative embodiment of routing within a network of a lighting control system according to the invention.
Figure 3B:
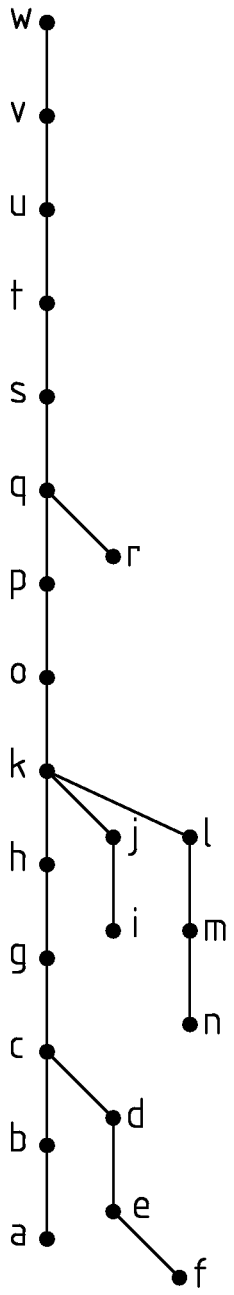
FIG. 3B shows a tree diagram of the network of FIG. 3A.

Each lighting node may switch between two communication modes: a unicast mode and a broadcast mode. In the unicast mode, the lighting node communicates with other nodes within the network by routing messages over the network according to the routing configuration, such as illustrated in FIGS. 2A and 3A. In the broadcast mode, a single message is broadcasted for receipt by multiple other nodes in a network.

Figure 4:
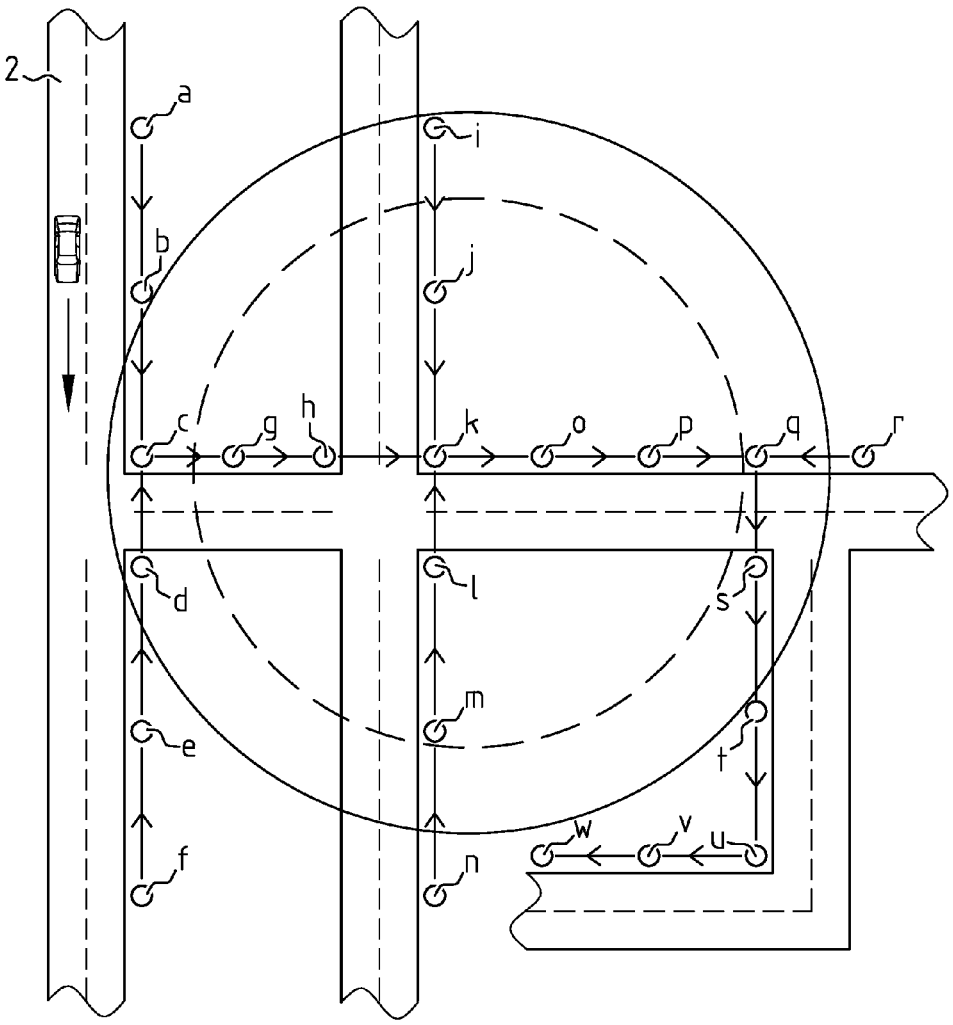
FIG. 4 illustrates the use of a broadcast mode for node k of the network of FIGS. 3A and 3B.

This is further illustrated in FIG. 4. In the unicast mode, the system of FIG. 4 has the same organization as the example of FIG. 3A. For example, if node k is to communicate with node r, the message is sent via four hops via node o, node p and node q to node r. In a broadcast mode however, a single message is sent by node k, for receipt by a number of other nodes within a predetermined range R1 (dashed circle). In this case, the nodes j, o, p, l, m, g, h are within this range R1. For example, node k needs to send the message "increase light level to 90%" to node g, h, o and p. As these nodes are within range R1, node k sends a single message in the broadcast mode, which is received by all four nodes. For example, node k includes in the message a unique identifier for identifying node k and the receiving nodes have been programmed to listen to messages broadcast by node k, as they belong to the same group of interrelated coordinates. In another example, node k includes in the message the unique identifiers of the receiving nodes, in this case node g, h, o and p.

Range R1 has a predetermined size which is in the example shown smaller than the maximum wireless range of node k, indicated with R2 (solid circle). The practical range of node k is dependent on environmental variables, such as weather conditions and wireless influences in the same frequency band. The predetermined range R1 is chosen equal to R2 or preferably smaller than R2 to ensure that the message sent by node k in the broadcast mode will be received by all targeted nodes.

Figure 5A:
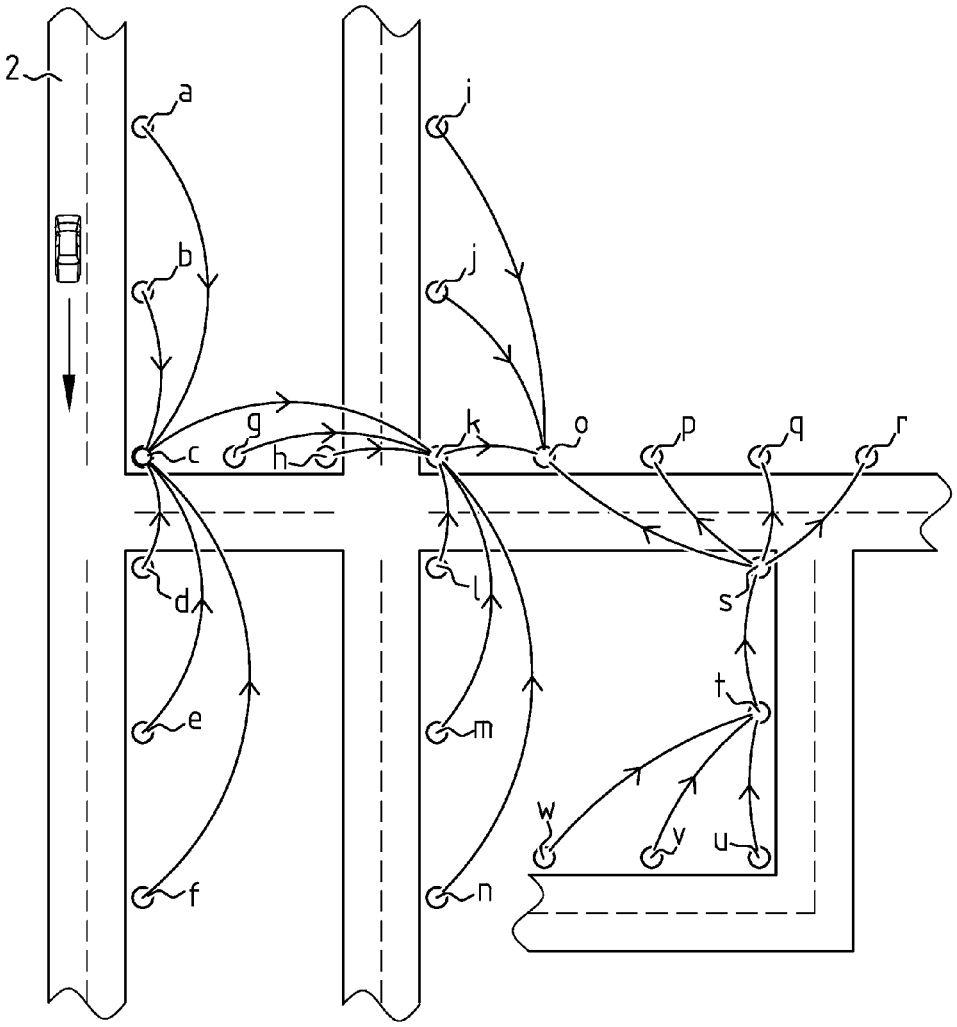
FIG. 5A illustrates an alternative embodiment of routing within a network of a lighting control system according to the invention using a hybrid star topology.

The network according to FIG. 5A has a hybrid star topology. In a star topology, a central node is defined to which all other nodes in the network are directly connected. A hybrid star topology comprises a number of interconnected central nodes. It is noted that this may also be viewed as a tree topology.

Figure 5B:
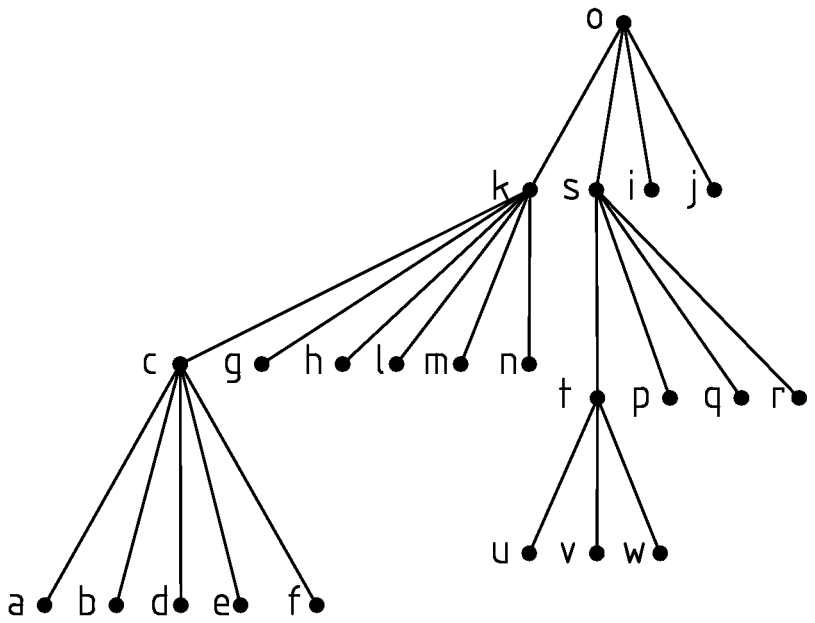
FIG. 5B shows a diagram of the network of FIG. 5A.

In FIG. 5A, the nodes c, k, o, s and t act as interconnected central nodes. Node c is connected to nodes a, b, d, e, f and k. Node k is connected to nodes c, g, h, l, m, n and o. Node o is connected to nodes i, j, k and s. Node s is connected to nodes o, p, q, r and t. Node t is connected to nodes s, u, v and w. This has been schematically illustrated in FIG. 5B. Although FIG. 5B suggests a hierarchy between nodes c, k, o, s and t, this may not be the case.

The present invention is by no means limited to the above described preferred embodiments thereof. The rights sought are defined by the following claims, within the scope of which many modifications can be envisaged.

The invention claimed is:

1. Lighting control system comprising a number of lighting nodes forming a wireless multi-node network, each lighting node comprising:

a light source;

a controller connected to the light source;

a wireless communication means connected to the controller for communication with other lighting nodes in the network;

a memory component adapted to store information relating to the geographical position of paths, intersections and/or areas of an infrastructural layout; and a processing component in communication with the lighting nodes and adapted to automatically associate each node to one of the stored paths, intersections and/or areas, and further being adapted to select for each first lighting node at least one second lighting node associated to the same one of said paths, intersections and/or areas, wherein the system is arranged to configure the network for the routing of messages between the lighting nodes on the basis of information about the geographical positions of the lighting nodes, the system being arranged to select for each first lighting node at least one second lighting node to which the wireless communication means of said first lighting node is to establish a routing connection on the basis of information about the geographical position of said first lighting node and the geographical position of said second lighting node, and wherein the system is arranged to select said second lighting node on the basis of information about the infrastructural layout of the area wherein the lighting nodes are positioned and the geographical positions of the lighting nodes in said area.

2. Lighting control system according to claim 1, further comprising a visualization component connected to the processing component and adapted to show the locations of the lighting nodes and the paths, intersections and/or areas on a map on an electronic display.

3. Lighting control system according to claim 2, further comprising a configuration component adapted to edit the associations between lighting nodes and paths, intersections and/or areas on the basis of user input.

4. Lighting control system according to claim 1, further comprising a configuration component adapted to edit the associations between lighting nodes and paths, intersections and/or areas on the basis of user input.

5. Lighting control system according to claim 1, wherein the processing component is adapted to select for each first lighting node at least one second lighting node neighboring said first lighting node and associated with the same path, intersection and/or area.

6. Lighting control system according to claim 1, wherein each lighting node comprises a switching component arranged for switching between an unicast mode, wherein the wireless communication means of said lighting node is arranged for sending a message to another node in the network via at least one routing connection by using an unique address of said other node, and a broadcast mode, wherein the wireless communication means of said lighting node is arranged for sending a message to multiple other nodes in the network within wireless range.

7. Lighting control system according to claim 6, wherein each memory component arranged to store a list of at least two other nodes in the network indicating whether to send messages to the respective node in the unicast mode or broadcast mode.

8. Lighting control system according to claim 7, wherein each lighting node is arranged such that for sending a message from said lighting node to multiple other lighting nodes the broadcast mode is used for sending said message to the subset of other lighting nodes which are within a predetermined range and the unicast mode is used for routing said message to the subset of other lighting nodes which are outside the predetermined range.

9. Lighting control system according to claim 6, wherein each lighting node is arranged such that for sending a message from said lighting node to multiple other lighting nodes the broadcast mode is used for sending said message to the subset of other lighting nodes which are within a predetermined range and the unicast mode is used for routing said message to the subset of other lighting nodes which are outside the predetermined range.

10. Lighting control system according to claim 9, wherein the predetermined range is equal or smaller than the wireless range of the wireless communication means of the respective lighting node.

11. Method for routing messages between lighting nodes forming a wireless multi-node network, wherein each lighting node comprises a light source, a controller connected to the light source and a wireless communication means connected to the controller for communication with other lighting nodes in the network, the method comprising:

configuring the network for routing messages between the lighting nodes on the basis of information about the geographical position of the lighting nodes by selecting for each first lighting node at least one second lighting node to which the wireless communication means of said first lighting node is to establish a routing connection on the basis of information about the geographical position of said first lighting node and the geographical position of said second lighting node;

obtaining information relating to the geographical position of paths, intersections and/or areas of an infrastructural layout;

automatically associating each node to one of said paths, intersections and/or areas; and selecting for each first lighting node at least one second lighting node associated to the same one of said paths, intersections and/or areas, wherein the second lighting node is selected on the basis of information about the infrastructural layout of the area wherein the lighting nodes are positioned and the geographical positions of the lighting nodes in said area.

12. Method according to claim 11, comprising the following steps for sending a message from a first lighting node to multiple other lighting nodes:

using a broadcasting mode for sending the message to the subset of other lighting nodes which are within a predetermined range; and using a unicast mode for routing the message to the subset of other lighting nodes which are outside said predetermined range.

13. A computer program product comprising non-transitory computer-executable instructions configured to, when executed, perform the method of claim 11, the method further comprising:

obtaining information relating to the geographical position of paths, intersections and/or areas of said infrastructural layout;

automatically associating each node to one of said paths, intersections and/or areas; and selecting for each first lighting node at least one second lighting node associated to the same one of said paths, intersections and/or areas, wherein the second lighting node is selected on the basis of information about the infrastructural layout of the area wherein the lighting nodes are positioned and the geographical positions of the lighting nodes in said area.

14. Computer program product according to claim 13, comprising the following steps for sending a message from a first lighting node to multiple other lighting nodes:

using a broadcasting mode for sending the message to the subset of other lighting nodes which are within a predetermined range; and using a unicast mode for routing the message to the subset of other lighting nodes which are outside said predetermined range.

* * * * *